US006375605B1

(12) United States Patent
Niedermeyer

(10) Patent No.: US 6,375,605 B1
(45) Date of Patent: Apr. 23, 2002

(54) METHOD AND APPARATUS FOR MAKING MULTICOLORED STACKS OF FOLDED PRODUCT

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 0 days.

(21) Appl. No.: 09/576,060

(22) Filed: May 20, 2000

Related U.S. Application Data

(63) Continuation-in-part of application No. 09/499,242, filed on Feb. 7, 2000.

(51) Int. Cl.[7] ..... B31B 1/34

(52) U.S. Cl. ..... 493/359; 493/231; 493/313; 493/315

(58) Field of Search ..... 493/231, 359, 493/123, 313, 315, 316, 317, 318, 194, 199; 83/86, 94, 650, 937

(56) References Cited

U.S. PATENT DOCUMENTS 4,349,185 A * 9/1982 Small et al. ..... 270/32
4,846,774 A * 7/1989 Bell ..... 493/87
5,795,433 A * 8/1998 Niedermeyer ..... 156/479

* cited by examiner

*Primary Examiner*—Rinaldi I. Rada
*Assistant Examiner*—Gloria R. Weeks

(57) ABSTRACT

Apparatus and method for producing selected color or material sequences with a stack of transversely folded products. Slit product width webs are longitudinally folded and advanced by slow speed feed rolls to a plurality of anvil rolls and segments are retarded so that voids are created in each of two or more streams of segments that are synchronized to create a continuous series of segments on the surface of a common carrier cylinder. Single or doublefolds can be made during or after transfer to the carrier. Reduced web speed from each parent roll results in longer run time between roll changes. In another embodiment, a central intermediate frame permits use of a plurality of half width cutoff units cooperating with a full width hollow carrier cylinder for processing of wide parent rolls without intermediate off-line slitting and rewinding.

13 Claims, 8 Drawing Sheets

W1
W2
S1
S2
V1
V2
FV1
FV2
R
R1
F1
F1'

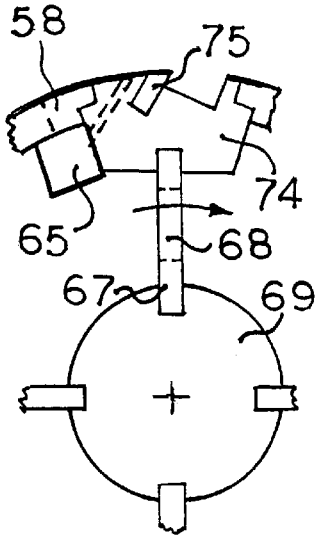
FIG. 12 B
FIG. 11
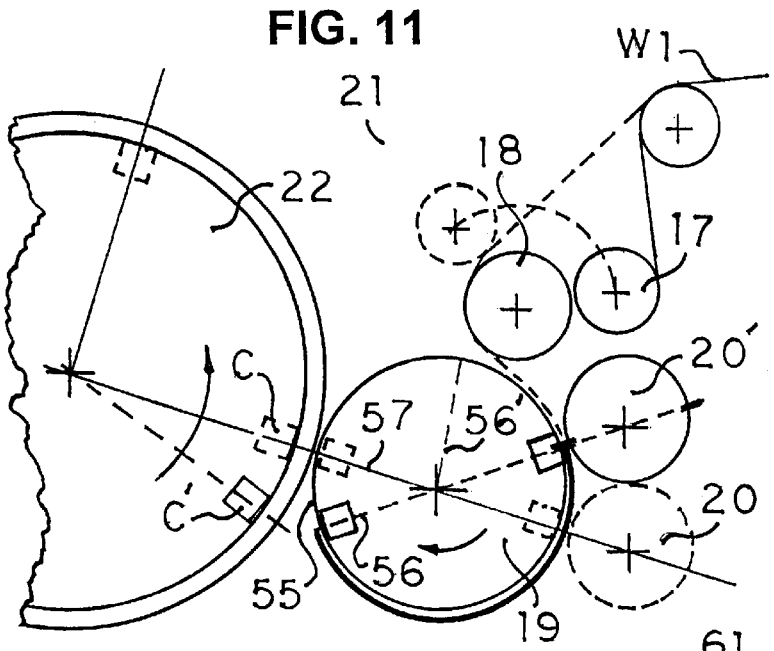
FIG. 12 A
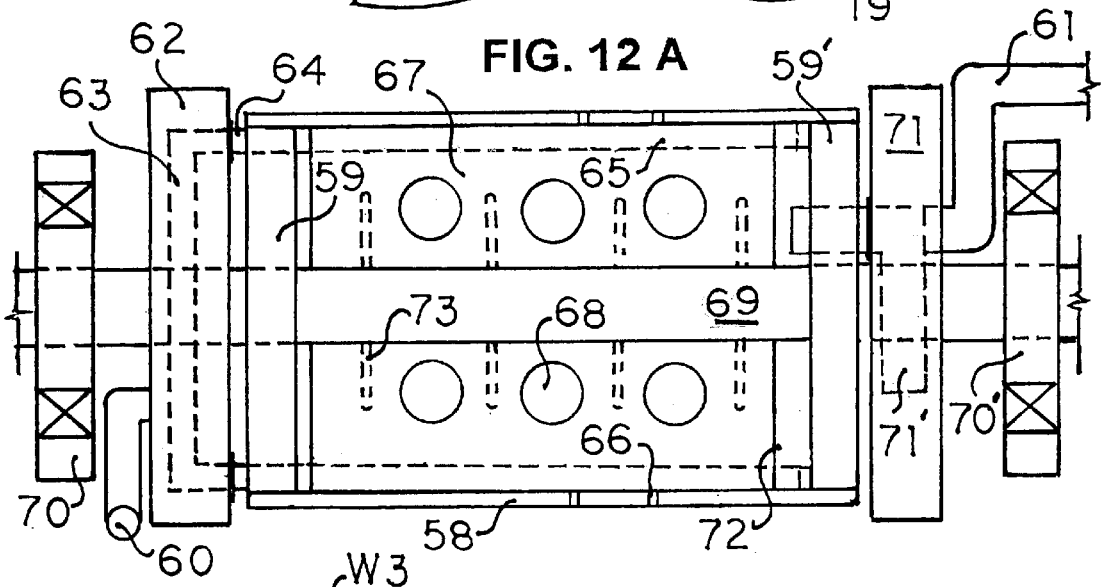
FIG. 15
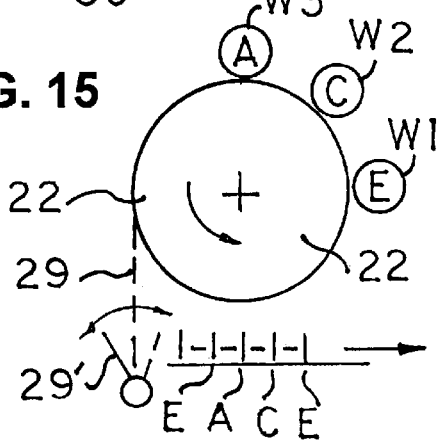
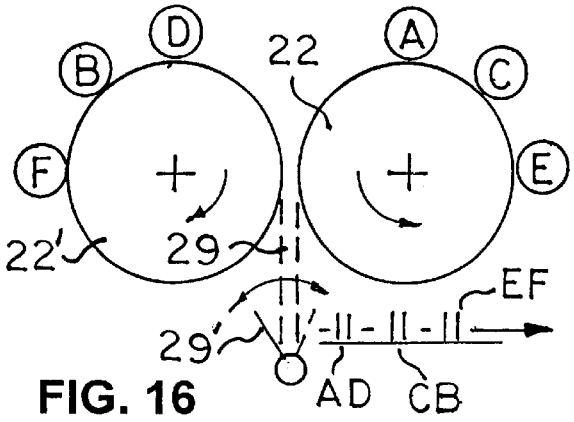
FIG. 16

2-COLOR 1+1

2-COLOR 2+2

3-COLOR 1+1+1

2-COLOR 2+1

2-COLOR 3+3

2-COLOR 3+1

4-COLOR MIX

2-COLOR 4+4

5-COLOR MIX

FIG. 17 A 2-COLOR MIX 1+1 (FIG 15)

C A C A C A C A C A C

PACKOUT C - A - C - A - C - A - C - A - C
STACK CA, CA, CA, CA, CA, ....

FIG. 17 B 2-COLOR DOUBLES 2+2 (FIG 16)

A C A C A C A C A C
B D B D B D B D B D packout A B - CD - A B - CD - A B - CD ....
stack ABCD, ABCD, ABCD, .....

FIG. 17 C 3-COLOR MIX 1+1+1 (FIG 15)

E A C E A C E A C E A C E

PACKOUT E - A - C - E - A - C - E - A - C - E
STACK EAC, EAC, EAC, EAC, ....

FIG. 17 D 2- COLOR SPACED 2+1 (FIG 15)

E A C E A C E A C E A C E

PACKOUT E - A - C - E - A - C - E - A - C - E
STACK EAC, EAC, EAC, EAC, ....

FIG. 17 E 2- COLOR TRIPLES 3+3 (FIG 16)

A C E A C E A C E A C E
B D F B D F B D F B D F packout EF - CD - AB - EF - CD - AB ....
stack EFCDAB , EFCDAB, .....

FIG. 17 F 2-COLOR SPACED 3 + 1 (FIG 16)

C A C A C A C A C A C A
D B D B D B D B D B D B

PACKOUT CD - AB - CD - AB - CD - AB ....
STACK CDAB - CDAB - CDAB ....

FIG. 17 G 4- COLOR MIX 1+1+1+1 (FIG 16)

C A C A C A C A C A C A
D B D B D B D B D B D B packout CD - AB - CD - AB - CD - AB - ....
stack CDAB, CDAB, CDAB, .....

FIG. 17 H 2-COLOR QUAD 4+4 (FIG 16)

G A C E G A C E G A C E G
H B D F H B D F H B D F H

PACKOUT GH - EF - CD - AB - GH - EF - CD - AB
STACK GHEFCDAB, GBEFCDAB, .....

FIG. 17 J 5-COLOR MIX 1+1+1+1+1 (FIG 16)

A E C A E C A E C A E C A E C A E C
D B D B D B D B D B D B D B D B D B packout CB - ED - AB - CD - EB - AD - CB - ED - AB - CD - EB - AD
stack CBEDABCDEBAD, CBEDABCDEBAD,

METHOD AND APPARATUS FOR MAKING MULTICOLORED STACKS OF FOLDED PRODUCT

This invention is a Continuation-in-Part of co-pending U.S. application Ser. No. 09/499,242 filed Feb. 7, 2000 which introduces the concept of producing sequences of folded product having different colors or materials in a stack.

BACKGROUND OF THE INVENTION

Since the 1940's most napkin folders were based on the methods and apparatus taught by Christman in U.S. Pat. No. 1,974,149 to make single transverse folded napkins.

This basic prior art (see FIG. 1) is typical for vacuum folders and is still practiced in present apparatus, including those with an additional roll to produce double folded dinner napkins like the apparatus of Nystrand in U.S. Pat. No. 3,689,061 (FIG. 1) U.S. Pat. No. 3,870,292 of Bradley (FIG. 3).

Folders with the three roll arrangement of FIG. 1 convert parent rolls of paper or other material into single transversely folded products from one or more juxtaposed webs by longitudional and cross folding before packout into one or more delivery lanes.

By using different longitudinal folding plates and re-sizing folding rolls, dispenser and other types of folded napkins are made using the basic idea of lifting the front panel portion with a coacting vacuum roll while the trailing panel portion is advanced by a carrier until release of the first panel to complete the fold.

To double production, two folders are arranged as in FIG. 2 to deliver a pair of superposed napkins which are packed out in pairs.

In the single or dual folder arrangements, all napkins in all delivery lanes are produced from the same parent roll and are thus of the same color or material.

U.S. Pat. No. 5,904,277 describes a transverse folder using an air blast to uplift the leading panel portion while the trailing portion is held on a carrier. The uplifted front portion subsequently contacts a stationary plate to complete the fold.

The instant apparatus uses the air blast/plate folding techniques of '277 as well as components in various combinations for internal air and vacuum conduits according to U.S. application Ser. No. 481,108.

SUMMARY OF THE INVENTION

Without requiring a coacting vacuum folding roll to complete a fold, apparatus of this invention includes a hollow carrier cylinder with internal vacuum and air conduits.

While hollow rolls are preferred, this invention can be practiced using solid rolls with holes drilled parallel to the axis of rotation for use as closed vacuum conduits.

For wider webs, larger diameter cylinders are used to minimize deflection, and beneficially provide more circumferential space to mount two or more segment cutoff units required to practice this invention.

By slow speed advancement of the incoming webs and slipping them one or more repeats on the surface of the anvil roll(s), a segment from each co-acting cutoff unit is advanced at full speed after cutoff occurs, with each anvil roll synchronized to place a segment on spaced repeats on the surface of a single common multi-repeat carrier cylinder.

when using two feed and cutoff units to advance two webs, the speed of each web is reduced to one-half of folder surface speed.

With three units, the speed of each web would be one third of folder speed.

Reduced web speeds results in longer parent roll run time between roll changes.

With hollow cylinders instead of solid rolls, wider machines become practical, and width of the inventive folders can be increased to handle parent rolls of 100".

For example, with the inventive apparatus using only white paper, a 200" parent roll can be slit in half. One web is processed in-line, and the other 100" web is advanced over two turning bars and superposed with the in-line web.

When paper machine widths approach 100", excessive deflection of the cutoff rolls can affect folder cutting quality and efficiency.

To overcome this problem, the invention describes a special cutaway central intermediate framework for using two circumferentially spaced cutoff units which are phased and synchronized to cut segments from product width webs slit from each half width parent roll web.

Use of the central cutaway frame for mounting partial width cutoff units also applies to the face-to-face arrangement of dual folders, each of which process two 100" webs, or using a plurality of cutoff units, two 200" parent rolls slit into four half width webs.

The use of two or more cutoff units in combination with slow speed web feed means defines different color and material delivery sequences heretofore not possible.

This invention also describes the use of multiple locations for removel of product and delivery of stacks. Each delivery system at a different location must accept product from the carrier at the folder production rate, but with separate delivery apparatus, digital switching of vacuum can produce different package counts at each location with more time for package count separation, stacking, and advancement to packaging machines.

In summary, the primary object of the invention is to provide apparatus for producing stacks having folded product of different colors, materials, or counts. all in a variety of sequences.

Another object is to provide different apparatus arrangements for producing more than one color sequence.

A further object of this invention is to feed multiple webs at speeds lower than the folder speed so that parent rolls last longer.

An object of this invention is to provide apparatus for rotation of parent rolls on an axis parallel to the carrier axis to present a juxtaposed plurality of longitudinally folded webs for ease of manual threadup into draw rolls.

Another object is to provide a pivotable S-wrap roll and coacting metering roll combination having an open upward facing nip for manual threadup from the top before pivoting the S-wrap roll into a run position.

An object of this invention is to provide a partial central framework to mount half width feed/cutoff units for synchronized cutting of longitudinally folded webs having a combined width equal to the width all incoming product web widths.

An object of the invention is to slit webs wider than the folder width and provide means to redirect a second half web to an in-line run direction superposed over the first half width web.

An object of the invention is to provide means for multiple product removal locations.

Another object is to electronically activate means for controlling the number and removal of different count at each of the multiple removal locations.

Other advantages and objects of the invention may be seen in the details of the ensuing specification.

BRIEF DESCRIPTION OF THE DRAWINGS

FIG. 11 is a side elevation schematic view of a web cutoff unit illustrating the web feed assembly for slow speed slipping advancement of a web length before segment cutoff.

FIG. 12A is a side elevation schematic illustrating a roll having a hollow shaft for low vacuum communication with slots for web slippage and high vacuum conduits and ports for segment advancement after the web is severed.

FIG. 12B is an end view cutaway schematic illustrating anvil mounts supported by a member affixed to the central shaft.

FIG. 15 is a simplified side elevation schematic illustrating three cooperating anvil rolls on a single folder.

FIG. 16 is a simplified side elevation schematic illustrating three cooperating anvil rolls on each of two folders arranged face-to face.

FIG. 17A is a numeric algorithm in chart form illustrating the delivery packout, and sequenced for 2-color mix 1+1 (see FIG. 13A)

FIG. 17B is a 2 color mix sequence like FIG. 17 produced on dual folders each having a single cutoff assembly (not illustrated in FIG. 13 series)

FIG. 17C is a numeric algorithm in chart form illustrating delivery packout, and sequence for a 3 color mix 1+1+1 (see FIG. 13C).

FIG. 17D is a numeric algorithm in chart form illustrating delivery packout, and sequence for 2-color spaced 2+1 using three cutoff units on a single folder (see FIG. 13D)

FIG. 17E is a numeric algorithm in chart form illustrating delivery packout, and sequence for 2-color mix 3+3 combination using a single folder (see FIG. 13E).

FIG. 17F is a numeric algortihm in chart from illustrating delivery packout, and sequence for 2 color spaced 3+1 (see FIG. 13F)

FIG. 17G is a numeric algorithm in chart form illustrating delivery packout, and sequence for a 4 color mix 1+1+1+1 (see FIG. 13G)

FIG. 17H is a numeric algortihm in chart form illustrating delivery packout, and sequence for 2-color quad 4+4 (see FIG. 13H)

FIG. 17J is a numeric algorithm in chart form illustrating delivery, packout. and sequence for 5 color mix (see FIG. 13J).

DETAILED DESCRIPTION

Figures 1, 2, 3, 4, 4A:
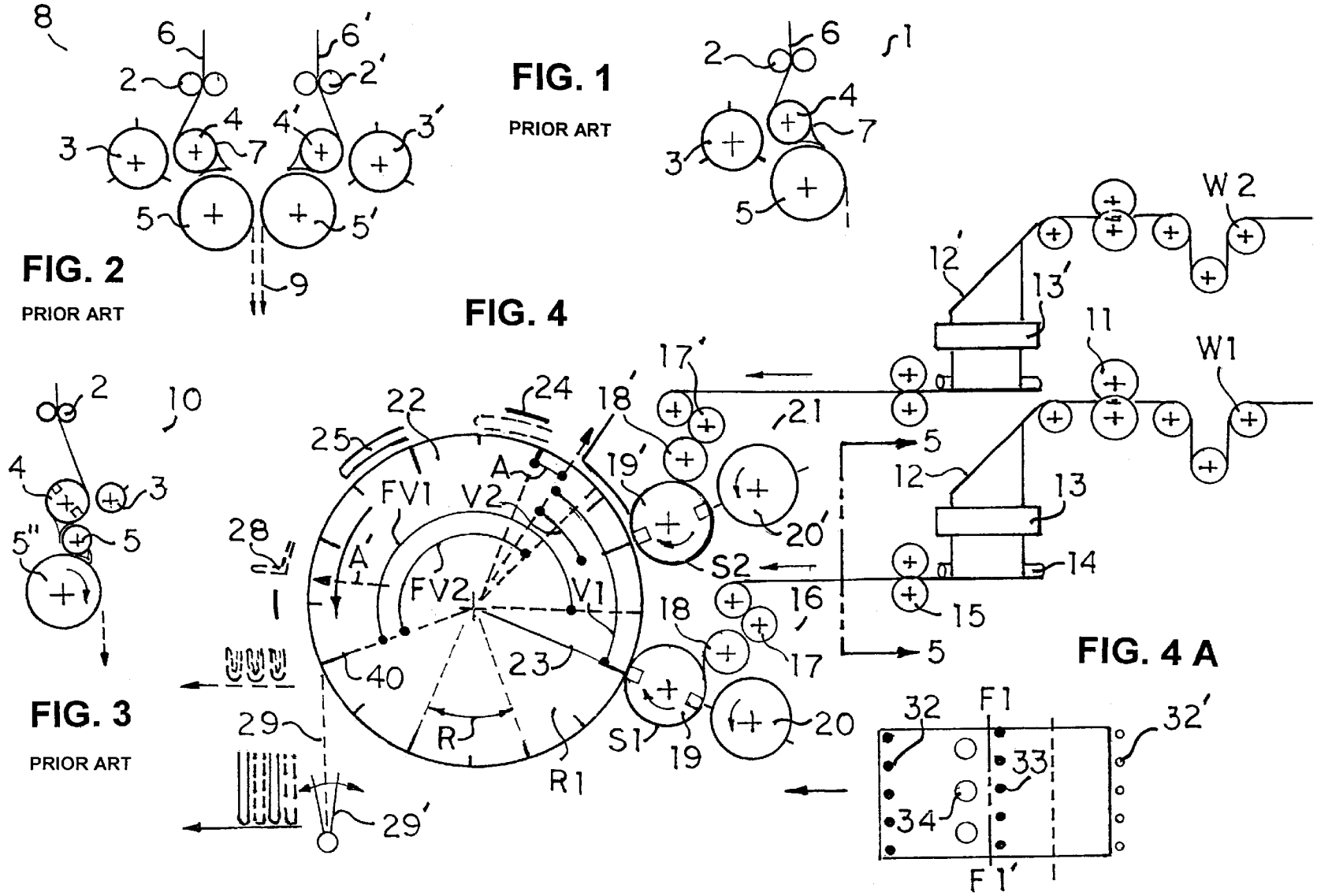
FIG. 1 PRIOR ART
FIG. 2 PRIOR ART
FIG. 3 PRIOR ART
FIG. 1 is a side elevation schematic view illustrating a prior art single transverse folding apparatus for consecutive packout of single napkins from a series of napkins to produce a stack.
FIG. 2 is a side elevation schematic view of two FIG. 1 folders arranged face-to face for packout of superposed pairs of napkins from a series of napkins to produce a stack.
FIG. 3 is a side elevation schematic view illustrating a prior art doublefold dinner napkin folder for consecutive packout of single napkins from a series of napkins to form a stack.
FIG. 4 is a side elevation schematic illustrating the instant air folder with two spaced anvil/knife roll sets each advancing cut segments to alternating repeat surfaces of the carrier/folding cylinder.
FIG. 4A is a plan view schematic illustrating typical vacuum port and air aperture patterns for singlefold product on one repeat surface of the carrier.

In prior art folders of FIGS. 1–3 rolls having the same function have the same reference numbers.

The apparatus 1 of FIG. 1 produces a singlefolded product and includes draw roll 2, knife roll 3, anvil roll 4, and carrier 5.

Prior art folders of FIGS. 1–3 range from about 16" roll face width to about 65" for a 4-wide machine.

Longitudinally folded web 6 (folding plates not shown) is advanced by draw rolls 2 and held on the surface of anvil roll 4 by vacuum ports (see FIG. 4 A for typical pattern) which communicate with vacuum conduits drilled into the solid roll blank parallel to the axis of rotation.

After a segment is cut by knife roll 3, the anvil roll vacuum grips the leading half panel until it reaches the release position 7. Similar vacuum ports in the carrier 5 located midway between segment ends advances the trailing portion until the lead panel portion is released from anvil roll 4 thus completing the fold.

FIG. 2 is a dual folder 8 comprising two FIG. 1 folders arranged face-to-face and using a cooperating belt delivery system to advance pairs of folded napkins vertically before they are packed out in pairs.

A two wide dual folder 8 processes two 2-wide parent rolls (4 product widths) and packs out two pairs (4 napkins) for serial delivery and stacking in two delivery lanes.

In a wider version, a four wide dual folder processes four 2-wide parent rolls (8 product widths) over 8 folding plates and delivers 4 juxtaposed webs from each folder which are superposed as pairs which are advanced to the deliverty belt system 9. Each packer stroke delivers pairs of napkins into each of four lanes (8 napkins).

Even if different colored parent rolls are used, prior art folders of FIGS. 1–3 each pack out and stack the same colored napkins in each delivery lane. Other prior art folders deliver the same unicolor stacks.

FIG. 3 shows a double transverse folding machine 10 which comprises the same rolls as FIG. 1 and 2 but has a second vacuum carrier roll 5" which advances the trailing portion of the already folded napkin while carrier 5 grips the folded edge of the half folded napkin before release.

In essence, FIG. 3 is like FIG. 1 with one additional roll added for the second fold.

In FIG. 4, full width web W1 is advanced through slitters 11 which slit the web into a plurality of product width webs that are folded longitudinally as they are pulled over V-fold plates 12 by draw rolls 13.

The individual webs pass over turning bars 14, through pull rolls 15 and a first web cutoff unit 16 comprising S-wrap pair 17, and metering roll 18.

Metering roll 18 feeds the web at a speed equal to the speed of the carrier surface divided by the number of cutoff units coacting with the carrier (in this case two). Subsequently, anvil roll 19 coacts with knife roll 20 to sever the web into segments S1, S2, etc.

For the upper web W2, similar numbers are used with prime (') marks, and the second cutoff unit is referenced 21.

Cutoff units 16 and 21 are spaced apart one repeat R along the circumference of the carrier, Cutoff units can be spaced differently including roll pairs for pinch cutoff and having a vacuumized slip surface.

In FIG. 4, segment S1 will transfer to repeat space R1 and after advancement and folding will correspond to folded product 25.

Anvil roll 19 is described in detail in FIG. 12A and comprises passages for low vacuum to be applied through slots in the roll surface, and conduits for high vacuum ports to grip the leading edge of a segment for transfer to the carrier.

In one embodiment, transfer of the segment from anvil roll 19 to the surface of carrier 22 would occur at the instant of alignment when the segment leading edge reaches line 23 and transfer would occur because of high vacuum applied to ports 32 along the leading edge (see FIG. 4A).

However, because this requires instantaneous speed up of the segment by carrier gripping vacuum V1 on lead ports 32 in the carrier surface, the preferred embodiment includes gripping assist just before transfer by high vacuum applied to ports in the anvil roll.

In FIG. 12A, anvil roll 19 includes low vacuum slots 73 for slipping the segment and high vacuum ports 66 for gripping the leading edge of the segment.

To provide vacuum assist, the anvil roll is rotated CCW (upstream) to provide time for application of the assist vacuum along arc 55 before transfer to the carrier surface as described above.

In FIG. 4, segment S1 will be placed on repeat surface R1. Segment S2 will be placed on the repeat ahead of segment S1 and after advancement becomes the folded segment (phantom, not referenced) under folding plate 24.

In FIG. 4, V1 shows the timing and duration of vacuum applied to the leading edge of S1, V2 likewise for S2, while vacuum FV1 is applied to midway fold line ports 33 for S1, and vacuum FV2 is applied to midway ports for segment S2.

A1 refers to the air blast used to uplift the lead panel on all serially advancing segments. A2 (shown phantom) is the air blast used if a doublefold is made like product 28,.

Folded product is delivered serially along path 29. Reciprocating fingers 29' pack out single napkins to form a continuous stack delivered in each lane of a multi-web, multi-lane machine.

FIG. 4A shows a typical pattern of vacuum ports for each repeat surface of the carrier. Transversely aligned ports 32 grip the leading edge at transfer to the carrier, 32' grip the next segment, and ports 33 grip along fold line F1–F1'.

Figure 5:
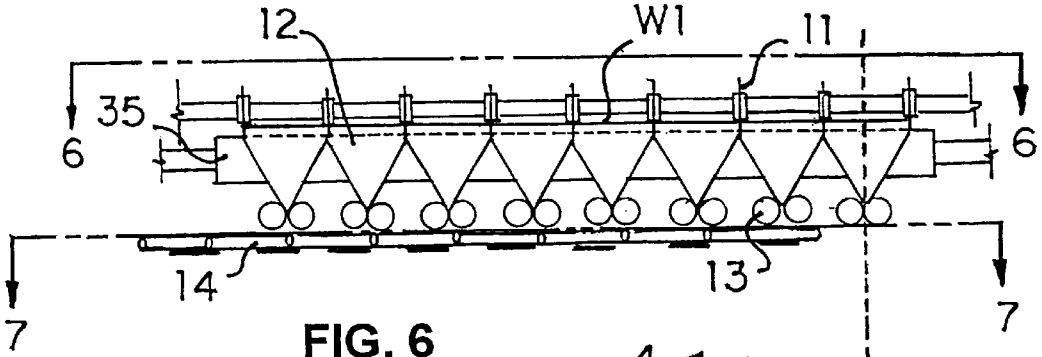
FIG. 5 is a front elevation view of the folding plate illustrating the arrangement of folding plates, draw rolls and turning bars shown in FIG. 4.
Figure 6:
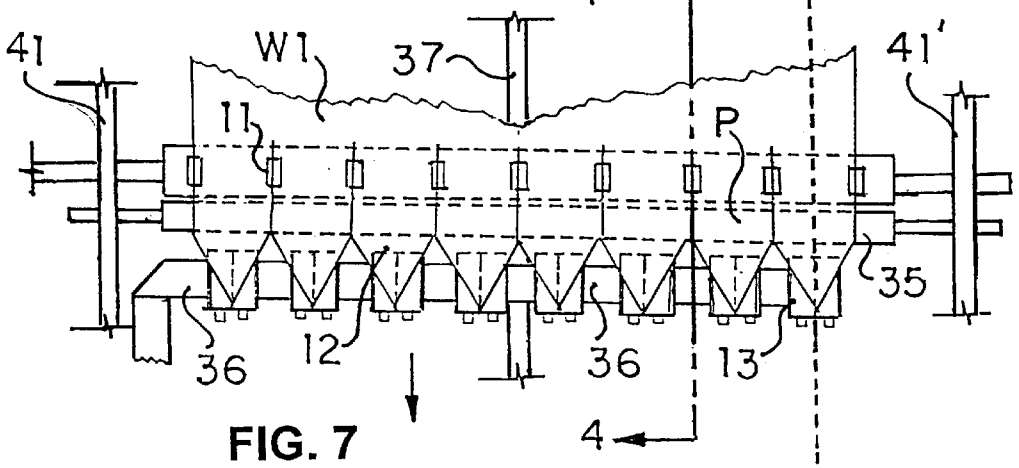
FIG. 6 is a top plan view illustrating a full width web being slit into product widths and advanced over V-fold plates into the nip of pull rolls before advancement over turning bars.

In FIG. 5, incoming web W1 is supported by slitter bedroll 35 as it is slit into product width P (see FIG. 6).

Preferably shear slitters 11 engage anvils on bedroll 35, but score slitters can be used. Once slit into product widths P, each web is drawn over folding plates 12 by draw rolls 13, threaded around turning bars 14 and pulled toward the machine by pull rolls 15 (see right side of FIG. 4).

In FIG. 6, after individual webs are longitudinally folded by plates 12, they are superposed for a short distance (as at 36) before each web is turned 90 degrees as at 38 for entry into the feed and cutoff units 16, 21.

Figure 9:
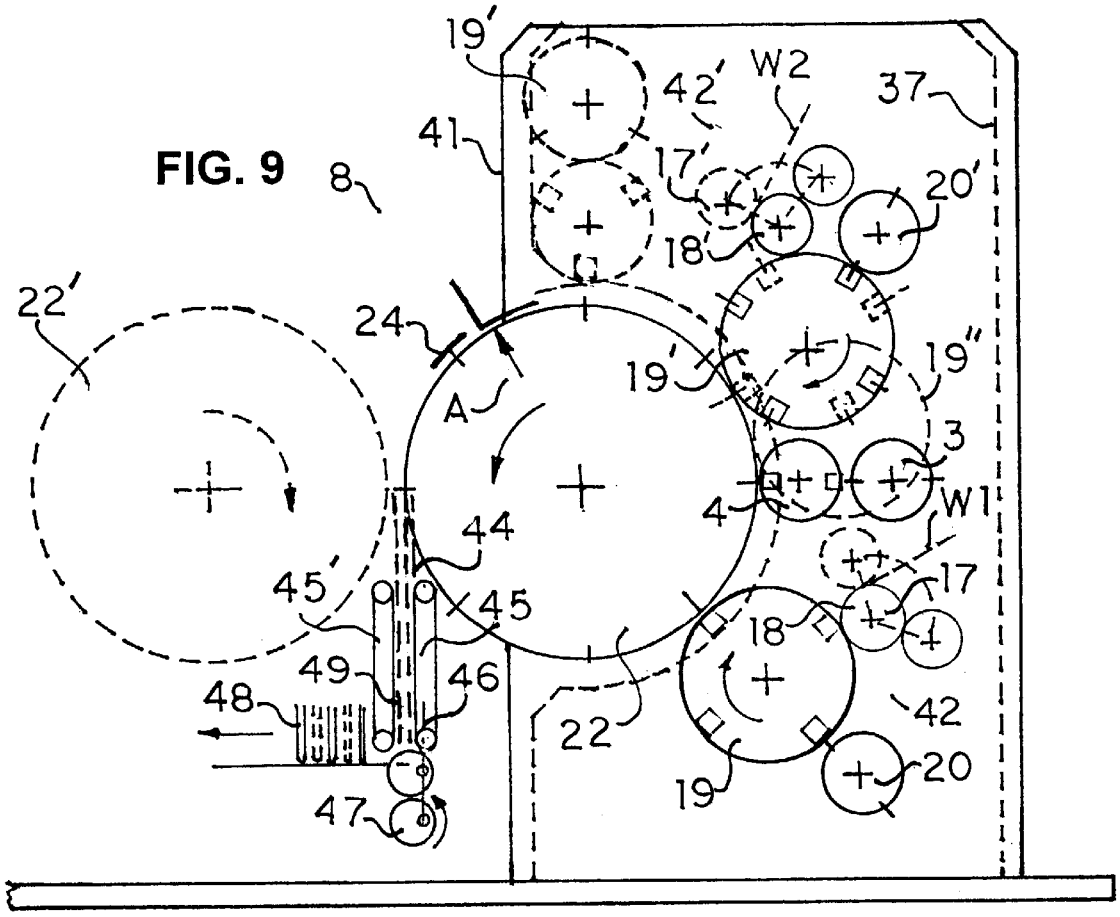
FIG. 9 is a side elevation schematic view illustrating a central frame (shown phantom) arranged with two web cutoff assemblies having pivotable S-wrap rolls.
Figure 10A:
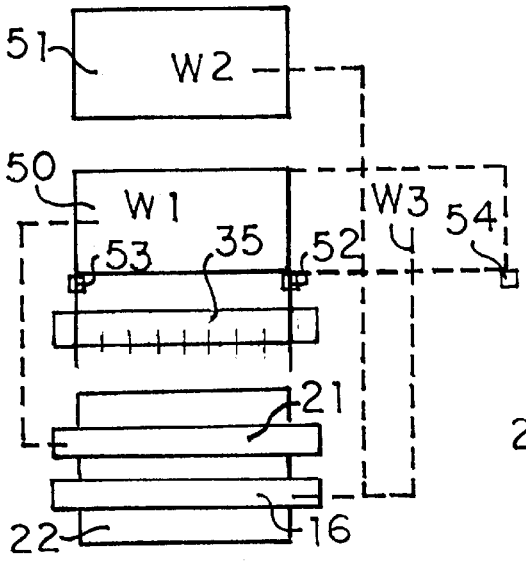
FIG. 10A is a plan view illustrating equipment layout for in-line processing of a web having a width equal to full width cutoff units on a folder.
Figure 10B:
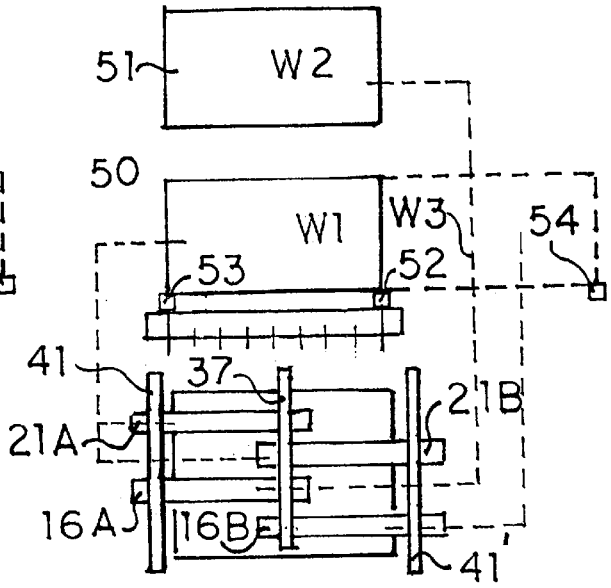
FIG. 10B is a plan view illustrating the arrangement of FIG. 10A for a folder requiring spaced and phased half width cutoff units for processing full width webs.

In FIG. 6, an intermediate partially cutaway central frame 37 is shown and described in FIGS. 9 and 10B.

Figure 7:
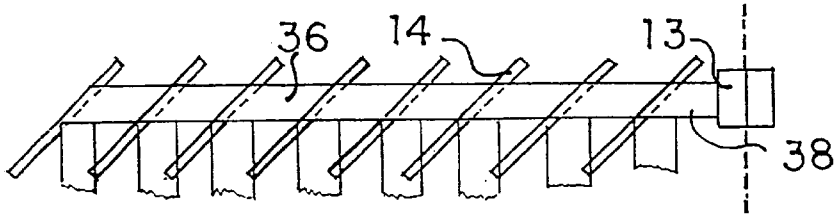
FIG. 7 is a plan view schematic of the superposed webs being separated and turned 90 degrees for transfer to the carrier.

FIG. 7 shows turning bars 14, superposed webs 36 and individual webs 38 in a separate plan view for clarity.

Figure 8:
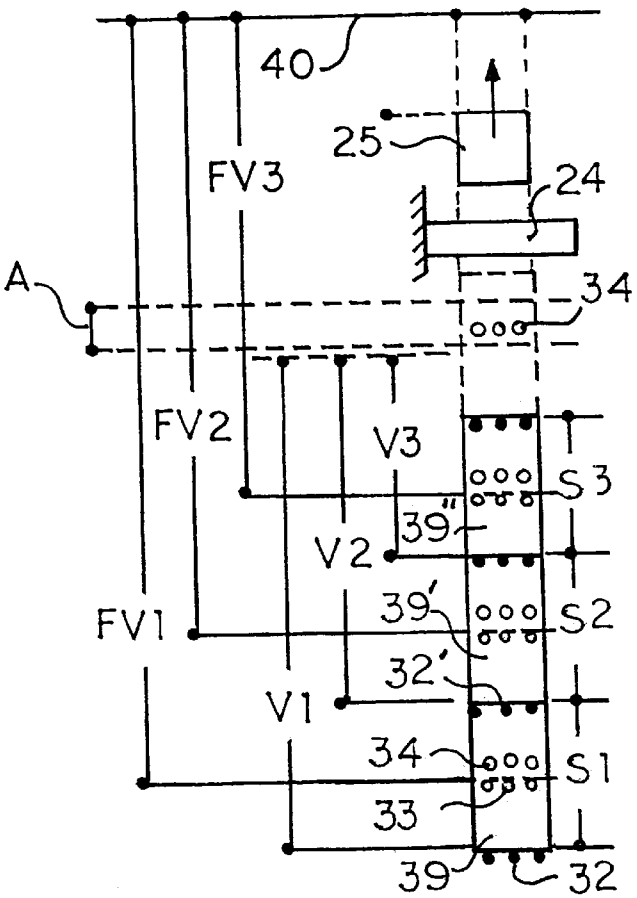
FIG. 8 is a plan view illustrating typical vacuum timing and duration for three consecutive carrier repeat surfaces including air blast and plate folds.

FIG. 8 shows a surface plan view of a series of segments placed on consecutice repeat surfaces on carrier 22. Vacuum ports 32, in the surface of the carrier and hold segments against the carrier surface but are shown solid for clarity.

FIG. 8 is similar to vacuum activation lines shown inside the cylinder 22 of FIG. 4, but in FIG. 8 additional vacuum grooves are shown for a third product. The corresponding side cutaway view of the stationary valve is not shown but would contain 3 grooves for vacuum V, 3 grooves for fold line vacuum FV, and one air blast groove. It is thus understood that to keep grooves separated, the diameter of the valve and cooperating carrier cylinder become extended.

In FIG. 8, vacuum V1 is applied to leading edge ports 32 segment S1 as soon as it is transferred to the carrier. Shortly thereafter, vacuum ports 33 for fold line FV1 is applied to the center of segment S1 to hold panels 39, 39' until product removal at position 40.

In succession, vacuum V2 is applied to ports for S2, vacuum FV2 for fold line ports 33 on segment S2, vacuum V3 is applied to ports for leading edge of segment S3 followed by fold line vacuum FV3 for ports 33 on segment S3.

Just before reaching application of air blast, vacuum for the leading edge of all segments ends while the segments are still held by vacuum ports 33 along fold lines, and FV1, FV2, and FV3 remain on to grip the folded product until it is taken off the carrier.

As described in FIG. 4, air blast uplifts the leading panel and the stationary plate completes the fold.

Folded product 25 advances to removel position 40.

Beginning vacuum earlier on the anvil roll has no effect on a segment after it is transferred to the carrier.

In FIG. 9. incoming web W1 is fed into cutoff unit 42, comprising pivotable S-wrap roll 17 engaging metering roll 18. The solid circle represents the run position and the dotted position is for threadup access for the incoming phantom web.

Operation is described above. In this instance speed of the metering roll surface will be one-half speed of the carrier surface.

In FIG. 9, anvil rolls 19, 19' have 4 repeats and are spaced apart. Typically, 2-time rolls 3, 4 as well as 4-time rolls 19, 19' are spaced on centerlines with two repeat surfaces between them at the carrier periphery.

The two-time roll set 3, 4 is shown for illustration only, as are the three-time knife/anvil roll set 19, since 2 and 3 repeat surfaces are used in different combinations and color sequences described below.

In FIG. 9, side frames 41 normally support the carrier cylinder and the plurality of associated full width cutoff units. Because knife-to-anvil settings are critical, any deflection in either roll affects operation, and for rolls width/diameter ratios that exceed pre-determined limits, a central frame 37 is used to support one end of half width cutoff unit rolls, including the S-wrap and metering rolls, One intermediate frame is shown, however it is within the scope of the invention to have a plurality of intermediate frames.

FIG. 9, represents a dual machine with identical folders arranged face-to-face. The left hand folder is identical and not shown except for carrier cylinder 22'.

Folded products from each folder are delivered serially in pairs. Each is stripped from the respective carrier by fingers 44 extending into grooves in the carrier surface (not shown). Products are delivered between belts 45, 45' and packed out by fingers 46 operated by orbital packer 47 to pack pairs of product into a stack 48 having alternate products made from webs of different colors or materials.

FIG. 10A illustrates essential components of the equipment line based on full width cutoff units and associated rolls. For webs wider than 70 inches, particularly those requiring a diameter over about 15" the use of two half width units (see FIG. 10B) is used to substitute shorter rolls of smaller diameters.

In FIG. 10A, excess trim and baggy edges for parent roll 50 for web W1 is slit at positions 52, 53 and pass to product slitter 35.

Referring back to FIGS. 5–7, note that an 8-wide parent roll is used. For 12" napkins, the trimmed web of 96" is slit to product widths of 12" for processing on carrier 22. In the instant teaching, web W1 is processed by cutoff unit 21 and web 2 by cutoff unit 16. Web W2 is fed from roll 51.

Web W3 represents a 200" parent roll which is edge trimmed at slitter positions 53, 54 and slit in half at position 52, Web W3 is processed over two 45 degree turning rods (not shown) and superposed over W1 for entry to folder 22.

In FIG. 10B, intermediate frame 37 permits two half width cutoff units 21A, 21B to be mounted between frame members 37, 41 as well as two half width cutoff units 16A and 16B.

In this instance, anvil and knife rolls can be 2-time or about 8" diameter in all four units.

Side view elevations are not shown but from FIGS. 4 and 9, it is evident that four cutoff units can be installed on a carrier having 8, or 10 repeats.

In FIG. 11, cutoff assembly 21 includes anvil roll 19 (shown solid) in contacting relationship with carrier 22 along a radial line from the carrier center.

Knife roll 20 (shown phantom) coacts with anvils in this position and produces a segment length equal to 180 degrees of the anvil roll. At the instant of cutoff the segment would have to accelerate from half to full speed with only carrier vacuum ports tending to grip the lead edge.

For a positive transfer, knife roll 20 is moved a predetermined distance upstream to position 20' on line 56, and at cutoff, the leading edge of segment S1 extends to line 56.

To advance the web to the transfer point,anvil roll vacuum assist starts before the anvil reaches line 56 and continues to line 57 (equal to arc 55).

Before the segment reaches the transfer point, high vacuum is applied to carrier surface vacuum ports via conduit C.

Carrier vacuum starts at position C' and grips the leading edge to transfer segment control from anvil vacuum to carrier vacuum.

In FIG. 11, incoming web W1 is threaded along the dotted path and after S-wrap roll 17 pivots to the run position (solid), the web advances from the metering roll and is held in sliding contact with low vacuum applied to slots 73 (FIG. 12A), starting at 56' and ending at 57.

Note there is a gap between metering roll 18 and anvil roll 19 to allow slippage because of the web speed mismatch.

In FIG. 12A, carrier cylinder shell 58 supported by end pieces 59, 59' rotates on shaft 69 housed in bearings 70, 70'.

Figure 14:
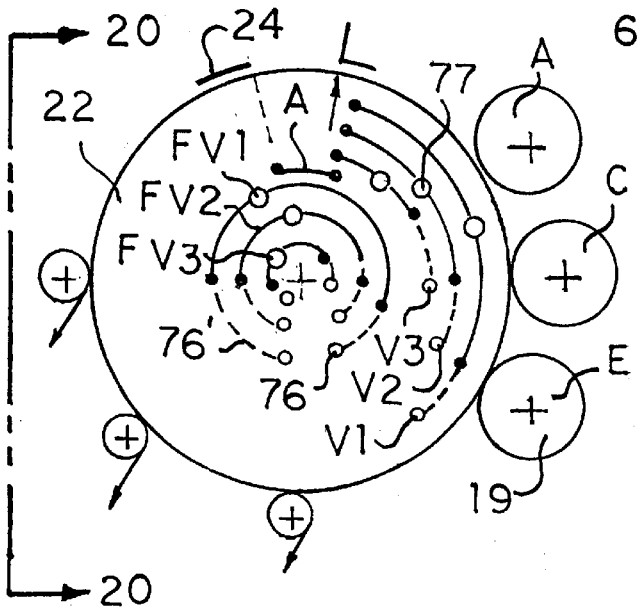
FIG. 14 is a side elevation schematic illustrating the vacuum timing and duration for an air folder with three cooperating anvil rolls.

During rotation, the flanged end 64 of high pressure conduit 65 contacts annular groove 63 in a stationary housing of vacuum valve 62 and applies high vacuum via inlet 60 to ports 66 in the shell surface when the vacuum groove is active (see FIG. 14 for description of typical timing and duration if vacuum cycle).

In FIG. 12A, low vacuum is applied via pipe 61 between blocks located in the low vacuum groove 71 of stationary valve ahead of line 56' and after line 57 (see FIG. 11) to conduct low vacuum to chamber 72 through groove 71'.

Low vacuum in chamber 72 communicates with open cylinder space between the shaft and shell by virtue of apertures 68 in the anvil support pieces 67 (see also FIG. 12B) when vacuum is applied.

Low vacuum draws the web to the anvil roll surface but since the web is continuous, allows it to slip until it is severed by the knife.

In FIG. 12B, anvils 75 are mounted in anvil holder 74 and spaced from shaft 69 by anvil supports 67. Supports 67 are fastened to shaft 69 to minimize deflection.

Before describing FIG. 13, reference is made to FIGS. 15 and 16.

In FIG. 15, three cutoff units are arranged around carrier cylinder 22 of a single folding apparatus. If three webs are used, Unit E will deposit the first segment, then in turn, units C and A, as shown in the delivery lane.

In FIG. 16, The same deposit sequence applies to the right side of the dual folder. The sequence for segment deposit for the left side is F-D-B, and the sequence for packout toward the right is EF-CB-AD, EF-CB-AD, ETC.

Each color or material combination that can be produced by single or dual folders of FIGS. 15, 16 are identified in FIG. 13 with a letter suffix from A to J.

It is noted the same letter suffixes apply to the summary data In FIG. 17, which compliments the functional illustrations in FIG. 13.

Figures 13A, 13B, 13C, 13D, 13E, 13F, 13G, 13H, 13J:
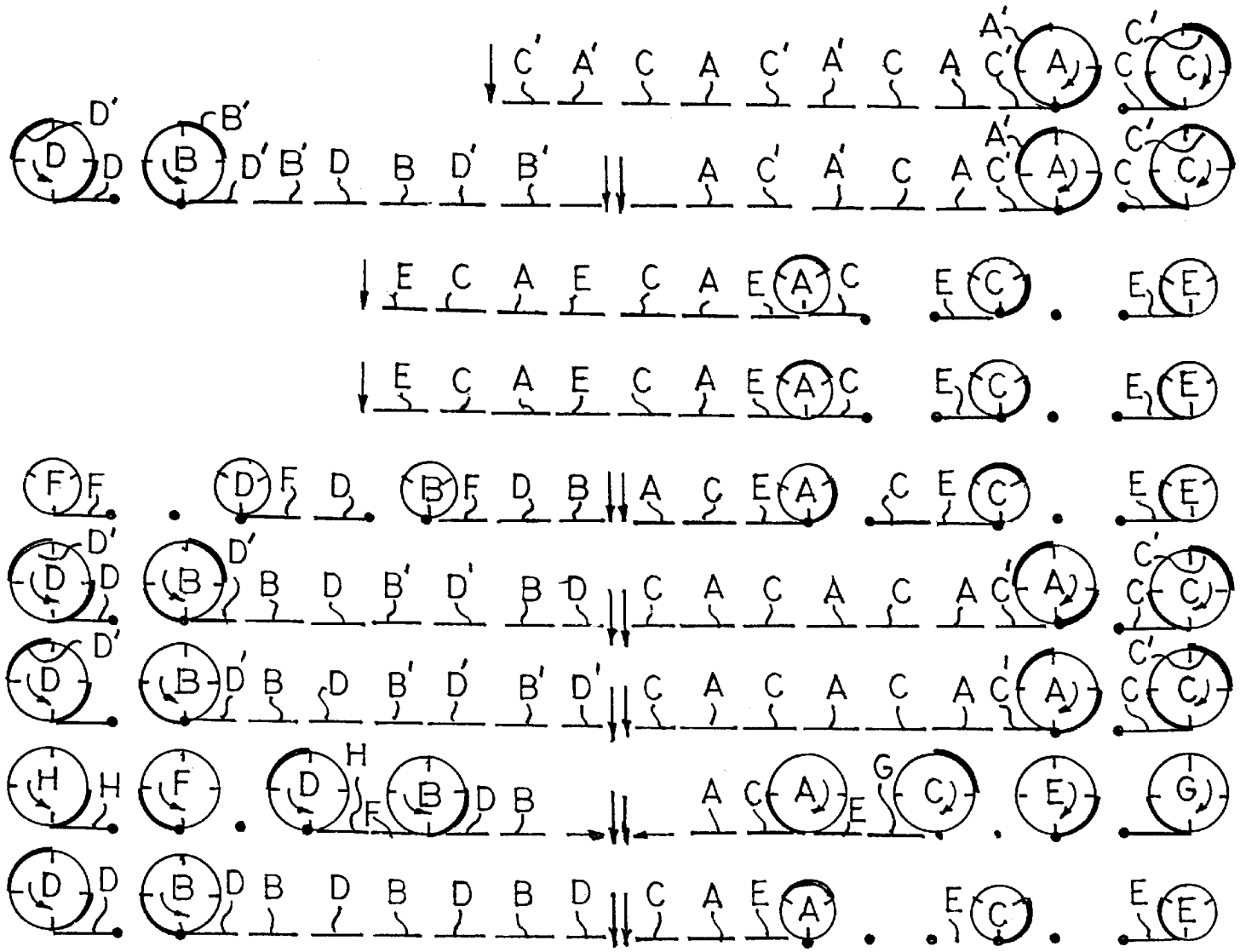
FIG. 13A is a diagram illustrating the sequence produced by two 4-time cutoff assemblies shown in FIG. 11 as applied to a single air folder (see FIG. 15).
FIG. 13B is a diagram illustrating the sequence produced by having two 4-time cutoff assemblies used on each of two folders arranged face-to-face and delivering pairs of superposed products in a single stream (see FIG. 16)
FIG. 13C shows the sequence made by a single folder having three 3-time cutoff assemblies.
FIG. 13D shows another sequence made by the folder of FIG. 13C.
FIG. 13E shows the sequence produced by having three 3-time cutoff assemblies on each folder arranged like FIG. 16 for delivery in pairs.
FIG. 13F shows the sequence produced by having two 4-time cutoff assemblies on each folder arranged like FIG. 16 for delivery of a two color sequence.
FIG. 13G shows the same arrangement as FIG. 13F for producing a 4-color sequence.
FIG. 13H illustrates the 2 color sequence produced with four 4-time cutoff assemblies on each of two folders arranged like FIG. 16.
FIG. 13J illustrates a 5-color sequence produced by two folders arranged like FIG. 16, one having two 4-time cutoff rolls and the other having three 3-time rolls.

In FIG. 13A each space is lettered to show which cutoff unit produced the product. Two units were used on a single delivery folder thus, the two units closest to the delivery system are involved namely A and C. (see FIG. 15).

Since the first segments are placed by the lower cutoff unit, the first segment placed is C followed by A. then C, A, C etc.

The 4-time anvil rolls are synchronized but 90 degrees out of phase, shown by the position of the segment on rolls C and A.

As segments are placed in sequence of C-A-C-A, etc, the same delivery sequence if followed as shown described in FIG. 17A as packout and stack listings.

The sequences from other single folders are shown in FIGS. 13C and 13D and follow the same description as FIG. 13A and as summarized in FIG. 17C and 17D respectively.

Dual folders and the sequences they produce are shown with rolls on the left and right sides, with folded segments placed and advanceing toward the center packout arrows in FIGS. 13B, 13F, 13G, 13H, and 13J.

In the above listed illustrations, 4-time rolls are shown but 2-time rolls can be substituted in some cases.

With dual folders (FIG. 16), the two streams of folded segments are superposed and delivered in pairs. In the summary of corresponding FIG. 17, packout lanes go to the right so the leading product is the product first deposited and shown on the right of the double arrows.

In FIG. 17 etc., serially delivered products shown directly under the title are shown horizontal but are actually delivered as a vertical stream thus the packing arrow determines the packout sequence shown under packout, and a complete sequence listed as 'stack'.

In FIG. 13F there are three 3-time cutoff units on each side of a dual folder, and the same terminology and descriptions apply.

FIG. 17E corresponds to 13E and summates the packout, sequence and stack content before the sequence repeats in the stack.

Figure 18:
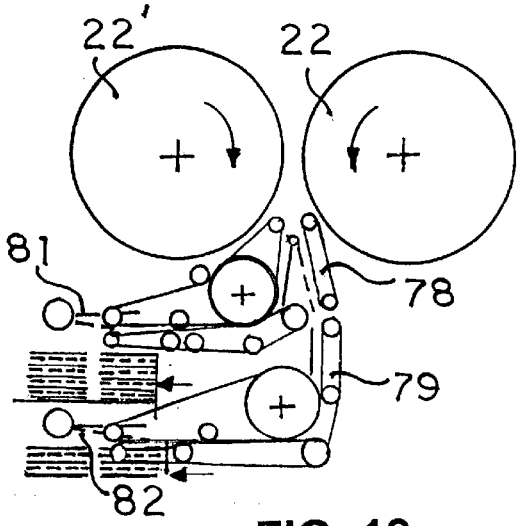
FIG. 18 is a side elevation schematic of a dual folder illustrating means for product removal at one of two locations.
Figure 19:
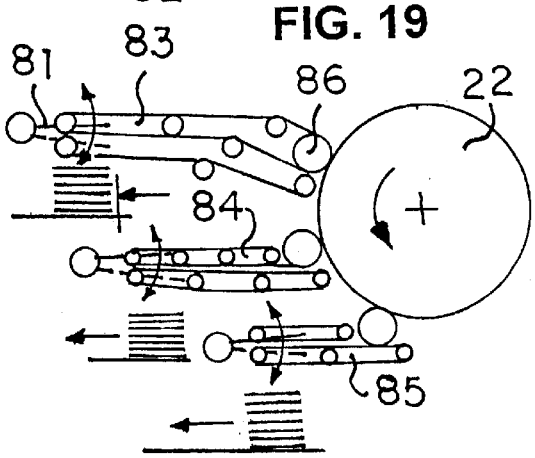
FIG. 19 is a side elevation schematic of a single folder illustrating means for product removal at one of three locations.

FIG. 14 is the side view of vacuum timing and duration similar to FIG. 8 with added features for multiple delivery positions shown in FIGS. 18 and 19.

In FIG. 14, three cutoff units 19, 19' and 19" place segments on carrier 22 in sucession and correspond to units E, C, and A of FIG. 15, and vacuum starts in groove V1 when a first segment is transferred and discontinues just before air blast occurs. Start and stop positions are shown solid.

Vacuum V with suffixes refer to vacuum applied to the leading edge of the segment, and vacuum applied to the transverse line of ports at the middle fold line are referenced VF.

V2 starts when unit C transfers a segment and also stops when air blast occurs. V3 starts when unit A deposits a segment and stops when air blast occurs.

Fold line vacuum VF1, VF2, and VF3 all start after the affected segment is deposited and remain on until product takeoff location 40.

In FIG. 14, grooves for vacuum V are extended as at position 76 to begin earlier (shown dotted) and likewise, grooves for foldline vacuum VF are extended as at position 76' to remain active longer (also dotted).

The change of duration and timing for different vacuum grooves relates to the proper time and location for ending vacuum in order to deposit folded segments in different locations, such as two delivery locations in FIG. 18 and three delivery locations in FIG. 19, and the means to achieve these results is detailed below. The length of each extension is pre-determined by accounting for the distance between takeaway positions and the time required for a pre-selected series (count) to pass that location in order to avoid overlap, etc.

In FIG. 18, diverter 80 delivers serial products in a selected sequence (see FIGS. 13 and 17). The number of carrier revolutions and repeats passing a reference point is determinate with digital counters to activate after a selected count, for example, any count that is a multiple of the selected color sequence, to activate an electronic signal to divert vacuum (as in FIG. 20) or extend the duration of vacuum cycles (as in FIG. 21).

In FIG. 18, upper belt system 78 delivers product serially which is packed into counted stack by packer fingers 81. When the sack count is complete, the electronically activated vacuum shift occurs and the next in series product will go to lower belt system 79 for stacking until count is removed with packer fingers 82. The vacuum changes occur to alternate the belt and packing system being used.

Delivery and packout of product at each location still occurs at full speed (foe example 450 napkins per minute), but the additional time between stacks permits use of slower speed automatic delivery and stacking devices.

In FIG. 19, a carrier 22 delivers product serially at full speed (450 npm) in a stream which is taken from the carrier at one of three locations.

For positive removal, stripper fingers (not shown) can be inserted within stripper grooves in the carrier surface (not shown herein).

Figure 20:
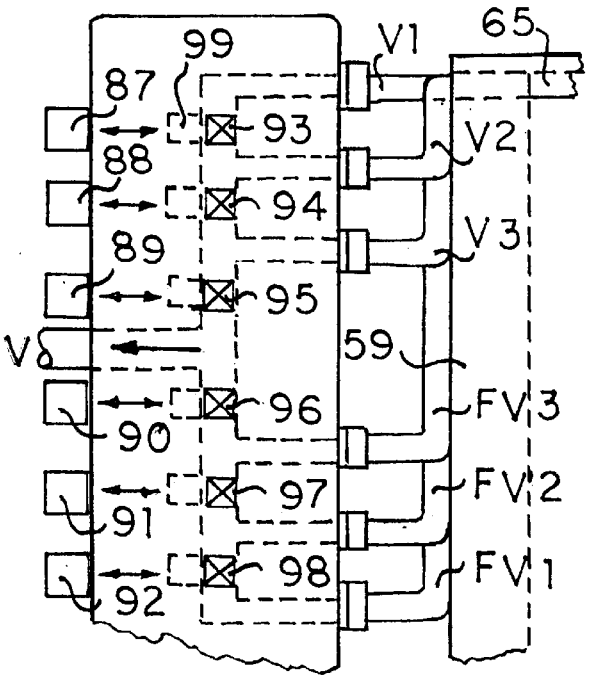
FIG. 20 is a side elevation of the upper left corner of the carrier cylinder viewed from sight line 20—20 in FIG. 14 illustrating sliding connections of 6 conduits to a non-rotating valve with electronic actuation of vacuum groove switching.

In FIG. 20, grooves for vacuum/air for product from three cutoff units include leading edge vacuum for V1, V2, V3, and fold line vacuum VF1, VF2, and VF3. A groove for air is needed but omitted for clarity.

A vacuum source (not shown) applies vacuum V to a common channel which is close ended by blocks 93–98.

Vacuum V is applied to V1 and VF1 when blocks 93–98 operated to move them into cutout spaces 99. Movement of the blocks is reversible by selective activation of motion devices 87–92.

It is noted that this arrangement programs the takeoff to occur consecutively at three locations in a fixed order such as V1-VF1, V2-VF2, V3-VF3, and back to V1-VF1, etc.

Figure 21:
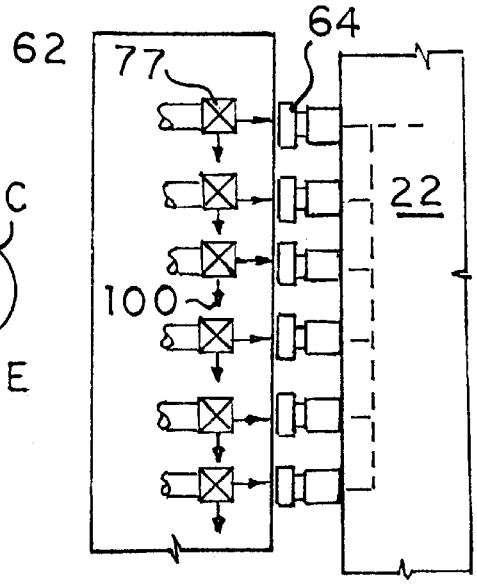
FIG. 21 is a side elevation view like FIG. 20 illustrating on-off actuation of vacuum for carrier conduits.

In FIG. 21, Similar vacuum connections communicate wish respective conduits in the carrier cylinder 22. Each line contains an electronically activated valve which shuts off vacuum by opening the vacuum inlet to atmospheric room pressure (as at 100), and engages vacuum for communication with the carrier conduit connections 64 by switching from atmospheric inlet to vacuumizing the grooves.

Figure 22:
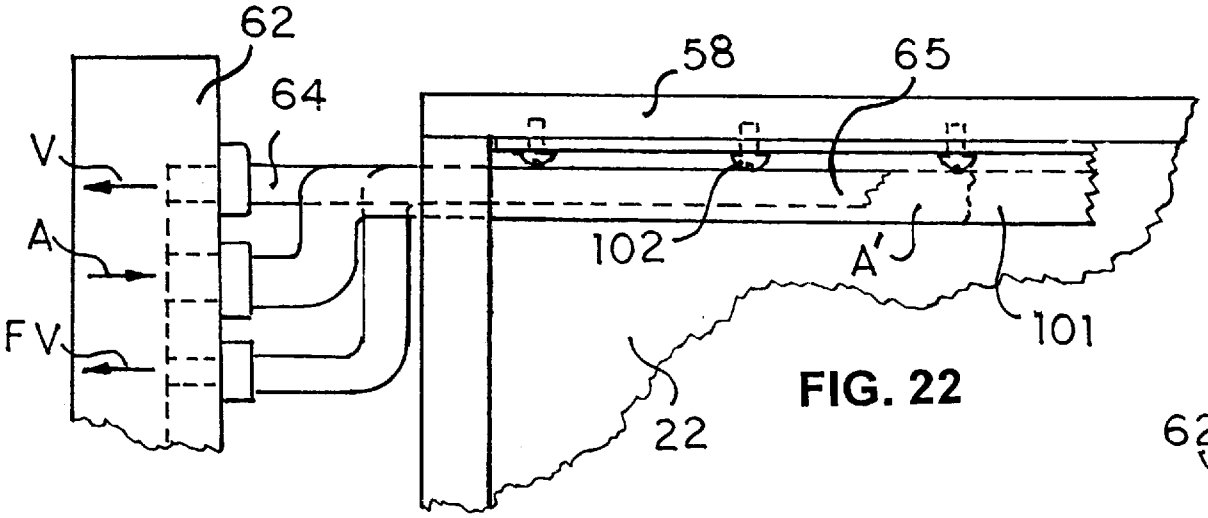
FIG. 22 is a side elevation like FIG. 20 illustrating two vacuum and one air conduit communicating with grooves in a non-rotating valve.

In FIG. 22, an extruded or molded conduit shape 101 is attached to the inside surface of carrier cylinder 22 and attached with fasteners 102.

Other components are similar and marked accordingly.

Figure 23:
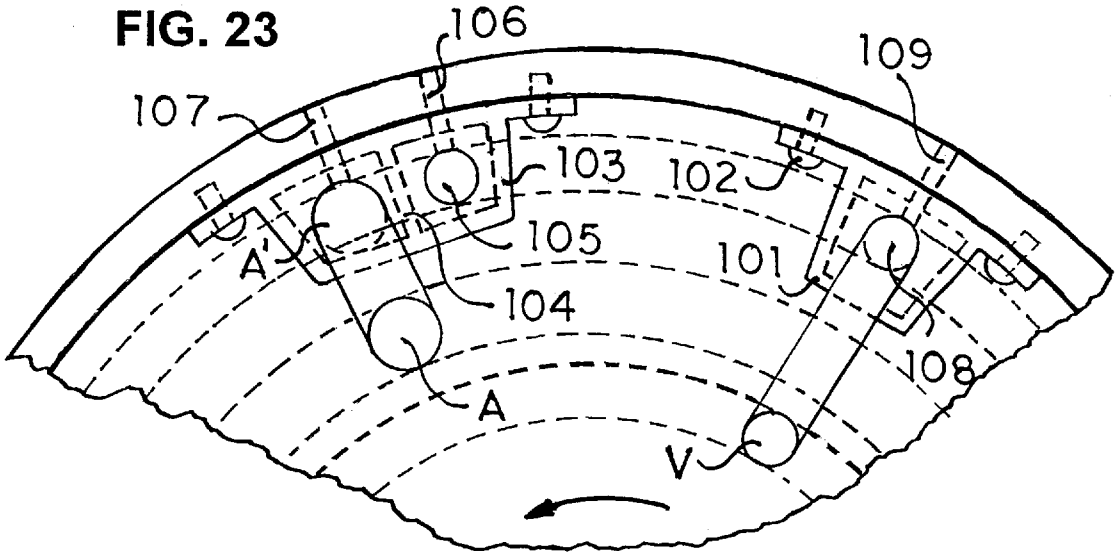
FIG. 23 is a cutaway end view of a vacuum conduit and a combination dual conduit for air and vacuum.

In FIG. 23, extruded or shaped conduit 101 is attached with fasteners 102 and communicates with vacuum source V via connection 108 to apply vacuum on the leading edge of a segment through ports 109.

On the left side, a dual purpose molded conduit 103 with divider 104 forms plenums for air blast A' to apertures 107 from connection A, and folding line vacuum VF for ports 106 via connection 105.

Figure 24:
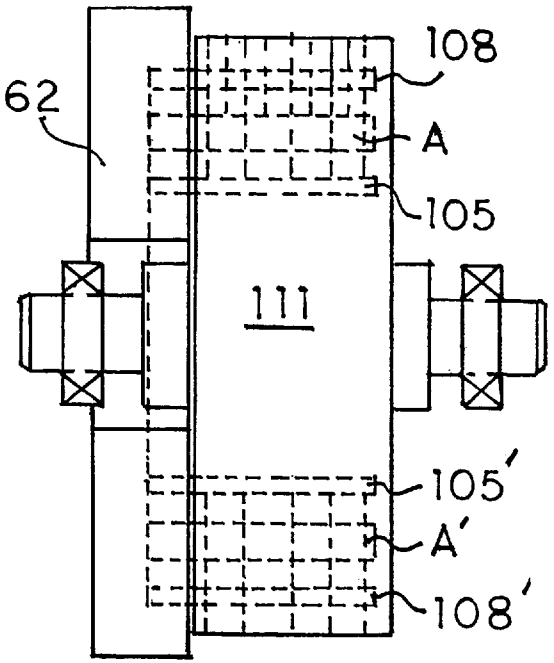
FIG. 24 is a side elevation schematic illustrating air and vacuum holes drilled in a solid roll blank for a 1-wide roll.state of the art folder.

In FIG. 24, 1-wide air folder 110 is made from a solid or forged roll blank 111.

Air conduit A and leading edge vacuum conduit 108 and fold line conduit 105 are defined by holes drilled parallel to the axis of rotation.

In other embodiments, multiple cutoff units cooperating with the solid vacuum rolls used in the prior art of FIGS. 1–3, and as described in FIG. 11 can be used but the rolls used as carriers must have a larger circumference and surface space to mount multiple cutoff units as well as multiple repeat surfaces for folding a series of segments.

In the instant teaching, the two vacuum conduits and one air conduit are shown, but it is within the scope of this invention to include drilled conduits for a plurality of segments from a plurality of cutoff units recognizing that the weight and diameter of solid rolls increase significantly for multi-width folders.

It is furthermore to be understood that the present invention may be embodied in other specific forms without departing from the spirit or special attributes, and it is therefore, desired that the present embodiments be considered in all respects as illustrative and, therefore, not restrictive, reference being made to the appended claims rather than to the foregoing description to indicate the scope of the invention.

Having thus described the invention, what is desired to protect by Letters Patent are the following:

What is claimed is:

1. Folding apparatus for producing folded products simultaneously from a plurality of different colored webs or materials to form stacks of product having sequences or color or materials therein comprising:

a pair of side frames to support;

means to slit webs into product width webs, to longitudinally fold the product webs, a plurality of web feed metering roll pairs, and, a plurality of cutoff units each including a knife roll and anvil roll for cutting separate streams of spaced segments and arranged to combine said separate streams of segments to form a continuous series of segments on successive repeats on the surface of a multi-repeat common carrier, wherein;

said web feed roll pairs each has a surface speed slower than the surface speed of a subsequent anvil roll to slidably advance said web for transfer to a spaced repeat of said anvil roll, said anvil roll having a plurality of repeats around the circumference, means to apply vacuum to a transverse line of ports along the leading edge portion, and to apertures in other selected surfaces of each repeat, said anvil roll and knife roll coacting to cut web portions transferred to said spaced repeats into segments, wherein spaced segments from an anvil roll are synchronized for placement on a carrier repeat between segments from other of said cutoff pluralities, each surface of said carrier having vacuum ports to grip the leading edge of segments for transfer from s aid anvil roll and a transverse line of port s to form a fold line in each repeat, means to apply vacuum to leading, folding, and selected ports, means to fold segments advancing on the carrier surface, means to remove said folded segments from the carrier, means to pack and deliver stacks of the folded product.

2. The apparatus of claim 1 including means to place segments transferred from each of said cutoff units on different spaced repeats on the surface of said carrier.

3. The apparatus of claim 1, wherein the anvil and carrier advancement means are made from solid roll blanks and have vacuum conduits defined by holes drilled parallel to the axis of rotation for the advancement means, the holes communicating with vacuum ports in the surface of the advancement means.

4. The apparatus of claim 1 wherein a repeat on said anvil roll surface is greater than one product repeat and the surface speed of said anvil roll is substantially equal to the speed of said carrier cylinder.

5. The apparatus of claim 1 wherein a web is advanced and transferred to said anvil roll at a speed equal to the speed of the carrier surface divided by the plurality of cutoff units cooperating with a common carrier and said web is severed to advance on spaced apart repeats of said carrier, the number of said repeats equal or greater than the plurality of cutoff units coacting with said common carrier.

6. The apparatus of claim 1 wherein the placement on said repeats of a common carrier is a function of spacing between said cutoff units and the rotary phase relationship of an anvil on said anvil roll relative to the angular position and peripheral spacing of said repeat surfaces of said common carrier.

7. The apparatus of claim 1 wherein said common carrier includes means to fold a series of consecutive segments, said means including a vacuum folding roll having a circumference divisible by the number of separate webs and cutoff units coacting with said common carrier.

8. The apparatus of claim 1 comprising the carrier of a first article folding apparatus arranged in face-to-face mirror image orientation with the carrier of a second folding apparatus wherein:

said first folding apparatus includes;

means to feed a plurality of slit and longitudinally folded product webs to at least two cutoff units of said first folder circumferentially spaced on the surface of a first common carrier, means to place each of said webs on the vacuumized spaced repeat of an anvil roll for slipping advancement, means to cut a segment and vacuum grip the leading edge for transfer to spaced apart repeats on the carrier surface of said first folder, means on the carrier of said first folder to fold and deliver a product between delivery belts, said second folding apparatus including;

means to advance a different plurality of slit and longitudinally folded product webs to at least two spaced cutoff units on said second folder spaced circumferentially on the surface of a second common carrier, means to place each product web on the vacuumized surface of an anvil roll for slipping advancements, means to cut a segment and vacuum grip a leading edge for transfer to spaced repeats on the carrier surface of said second folder, means on a carrier of said second folder to fold and advance a product between said delivery belts, said second product superposed on product from the first folder, said superposed products removed from said delivery belts in pairs.

9. The apparatus of claim 8 wherein one of said folding apparatus in said face-to-face orientation has a plurality of cutoff units greater than the number of cutoff units in the other of said folding apparatus.

10. The apparatus of claim 1 including intermediate framework parallel with and between said pair of side frames, means to support one end of at least one cutoff unit having a width equal to a first portion of parent roll width, and support one end of additional cutoff units having a width equal to a second portion of said parent roll, said first and second portions equal to the parent roll full width.

11. The apparatus of claim 1 wherein at least one color sequence of folded articles is removed from the surface of said common carrier at a different location from another color sequence of folded articles.

12. The apparatus of claim 1 including two or more cutoff units coacting with a common carrier wherein spaced segments from each anvil roll are transverse folded in cooperation with said common carrier before being combined with transverse folded segments from the second anvil roll to form a consecutive series of folded segments on said common carrier.

13. A method of folding a series of consecutive segments whereby portions of said series are derived from parent rolls of different colors or material including the steps of:

advancing a plurality of webs, slitting said webs to product width, folding each web longitudinally, advancing each web through a plurality of draw rolls and slow speed metering rolls, placing each web on one anvil roll of an anvil roll plurality each having vacuum apertures to advance and control said webs in sliding advancement to a spaced repeat on the surface of said anvil roll, cutting a first series of segments from one of said webs and concurrently gripping the leading edge of said segments with vacuum to increase segment speed to the surface speed of said anvil, transferring said first series of segments to spaced repeats on the carrier surface by activating vacuum on the carrier and deactivating vacuum on said anvil, said carrier surface having a speed equal to the surface speed of said anvil, advancing said first series of segments from the first anvil roll, advancing another series of segments from other of said anvil roll pluralities for placement on the carrier between said first series of segments to form a continuous series of intermixed segments, folding the series of consecutive segments on the carrier, removing said folded segments from the carrier.

* * * * *